US005794816A

United States Patent [19]

Pliler et al.

[11] Patent Number: 5,794,816

[45] Date of Patent: Aug. 18, 1998

[54] VENDING MACHINE

[76] Inventors: David B. Pliler, 40880 Via Media, Temecula, Calif. 92591; Matthew A. Stevens, 1232 E. Elmwood Ave., Burbank, Calif. 91501

[21] Appl. No.: 642,446

[22] Filed: May 3, 1996

[51] Int. Cl.[6] ..... B65H 3/60

[52] U.S. Cl. ..... 221/203; 221/265

[58] Field of Search ..... 221/265, 282, 221/277, 264, 203, 248

[56] References Cited

U.S. PATENT DOCUMENTS 3,804,294 4/1974 Householder ..... 221/265

5,176,290 1/1993 Schwarzli ..... 221/203

*Primary Examiner*—Kenneth Noland

*Attorney, Agent, or Firm*—Baker, Maxham, Jester & Meador

[57] ABSTRACT

A dispensing apparatus for dispensing bulk articles, comprises a housing having a receptacle and a dispensing chute, an article reservoir mounted on the housing above the receptacle, and a rotatable dispensing wheel disposed between the receptacle and the dispensing chute and operative to selectively dispense articles from the receptacle to the chute, the dispensing wheel having at least one article cavity for receiving and depositing a predetermined quantity of articles in the chute, the cavity defined by walls diverging away from an upper peripheral edge.

20 Claims, 4 Drawing Sheets

VENDING MACHINE

BACKGROUND OF THE INVENTION

The present invention relates to vending machines and pertains particularly to an improved vending machine having an improved dispensing wheel.

Coin operated dispensing machines have been widely used for many years as a convenient and economical way to get certain consumer products to the consumer. Such machines are widely used for many small packaged items such as cigarettes, chewing gum, candies and other snack foods. Certain types of vending machines have been made which are suitable for dispensing of individual or multiple items such as gum, candy or tablets from bulk quantities. One such widely used machine is frequently referred to as a gum ball machine.

There is often a need to dispense one or more articles in the form of pills or tablets such as medicine, breath mints or the like. Many these type medications and other pharmaceutical items are in the form of coated tablets or gel capsules and frequently have a tendency to stick together. For this reason, it has been found that these items cannot be reliably dispensed from existing machines. These items frequently clump together and existing machines tend to jam frequently when articles like gel capsules are attempted to be dispensed.

Referring to FIG. 1, an exemplary embodiment of a typical prior art machine as discussed above, of the gum ball type is illustrated. The basic machines are old and well-known and generally comprise a base 10, having a chute 12 with a top opening for receiving articles and a front opening with a flap-type cover or door 14 for dispensing one or more articles from bulk quantities in a transparent reservoir 16. This reservoir may be either glass or transparent plastic.

Located at the bottom of the reservoir 16 is a dispensing mechanism or assembly as best illustrated in FIG. 2 which comprises a hopper or receptacle 18 having a generally cylindrical receptacle 20 with an opening not clearly shown, directly into the top of hopper 12. One style of dispensing wheel which mounts within the recess or receptacle of the hopper comprises a generally circular wheel 22 having an outer rim, and inner hub and thin vane-like spokes extending radially outward to the rim. A second part of the dispensing wheel is referred to as a wing and is a fan shaped structure with an upper disc with slots and adjacent axially depending paddle-like structures that extend into the openings between the spokes of the wheel 22. This combined mechanism enables the adjustment of the size of the charge of articles received and dispensed by relative rotation between the main wheel 22 and the paddle wing 24.

An upper housing or half-cover 26 fits over the dispensing wheel as it rests within the Hopper and includes a pair of spring brush or sweepers 28 and 30 which are positioned in very close proximity to the upper surface of the dispensing wheel. These act as barriers and force the articles to be dispensed to remain in the open half-circle portion of the wheel or cover. Articles to be dispensed fall into openings in the wheel and move with rotation of the wheel under the cover portion covering the opening into the chute. As the dispensing wheel is rotated by means of a coin controlled mechanism as will be described, articles to be dispensed fall into the openings into the dispensing wheel and move beneath the half-cover 26 to a position to then fall into the hopper 12. This type of dispensing wheel works very well for many articles, but has been found not suitable for certain articles such as gel caps which applicant desires to suspense.

A cover 32 locks the entire assembly together by means of a lock nut 34 operated by a key 36 on the upper end of a mounting rod 38, which is secured at its lower end in the base housing 10.

A suitable dispensing machine of this type can be obtained from Machine-O-Matic Ltd. of Ontario, Canada. The dispensing of articles from the machine is controlled by a coin operated mechanism 38 whose description and details may be found in U.S. Pat. No. 4,534,492 issued Aug. 13, 1985 to Schwarzli.

Referring to FIG. 3 an alternate form of dispensing wheel for the above-referenced machine is illustrated and comprises a rotatable disc having a plurality of circular through holes 42, extending from the upper surface to the bottom surface. The disc takes the place of both of the members 22 and 24 of the prior described dispensing wheel and has a fixed capacity. This requires the replacement of the wheel to change the volume of articles dispensed. This wheel is also equipped with upwardly extending fingers 44, which extend into the reservoir 16 and stir the bulk articles contained therein. This dispensing wheel, like that of FIG. 2, also suffers from the problem of jamming when certain articles are attempted to be dispensed.

Accordingly it is desirable that there be available dispensing machines capable of dispensing selected quantities of articles such as gel capsules and the like without jamming.

SUMMARY AND OBJECTS OF THE INVENTION

It is the primary object of the present invention to provide an improved dispensing machine.

In accordance with the primary aspect of the present invention, a dispensing apparatus for dispensing bulk or unpackaged articles, comprises a housing having a receptacle and a dispensing chute, an article reservoir mounted on the housing above the receptacle, and a rotatable dispensing wheel disposed between the receptacle and the dispensing chute and operative to selectively dispense articles from the receptacle to the chute, the dispensing wheel having at least one article cavity for receiving a predetermined quantity of articles depositing in the chute, the cavity defined by downwardly diverging walls.

BRIEF DESCRIPTION OF THE DRAWINGS

The above and other objects and advantages of the present invention will become apparent from the following description when taken in conjunction with the accompanying drawings, wherein:

FIG. 5 is a section view taken on line 5—5 of FIG. 4; and.

DETAILED DESCRIPTION OF THE PREFERRED EMBODIMENT

Figure 1:
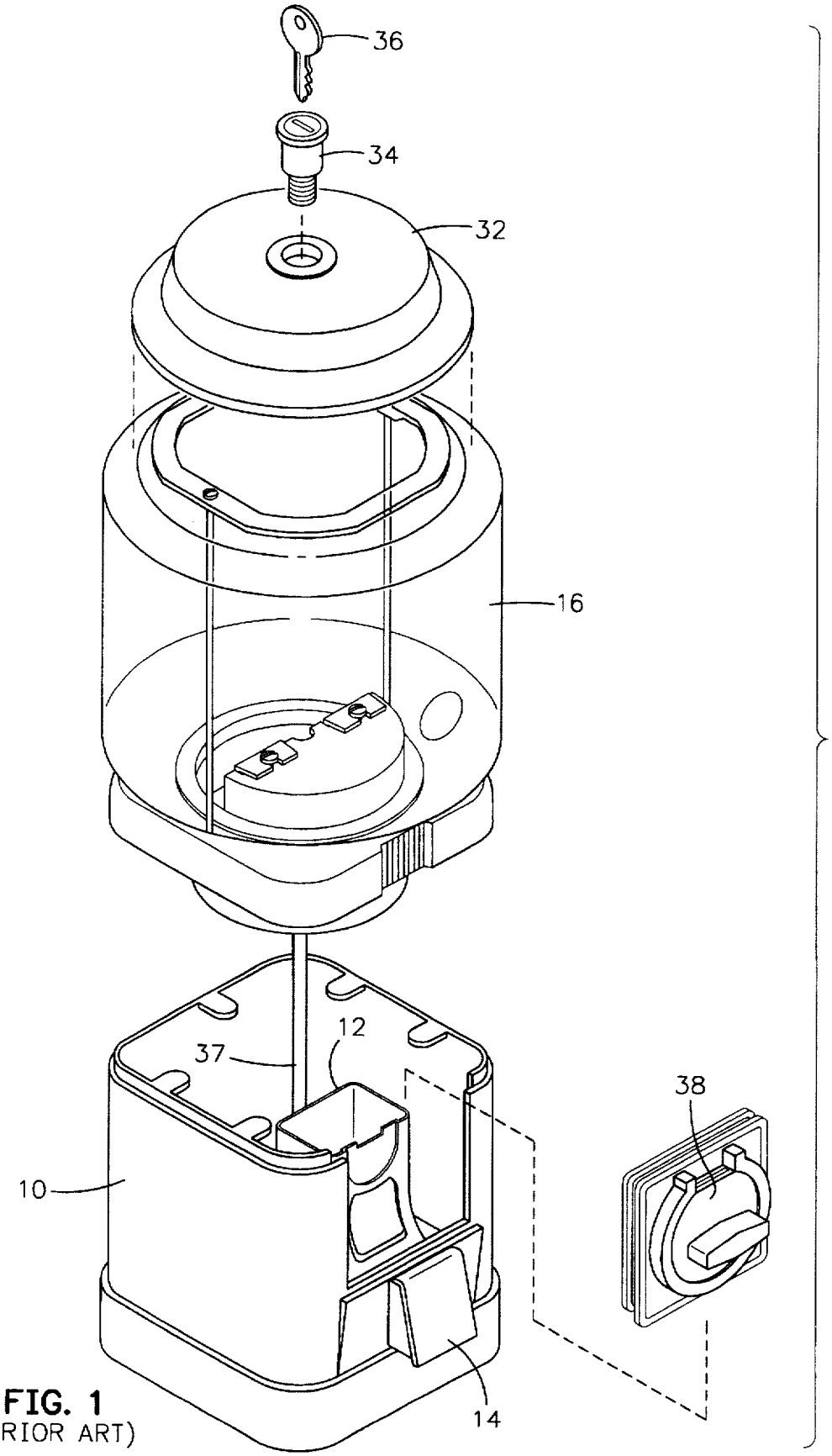
FIG. 1 (PRIOR ART)
FIG. 1 is a exploded perspective view of a prior art dispensing machine wheel.
Figure 4:
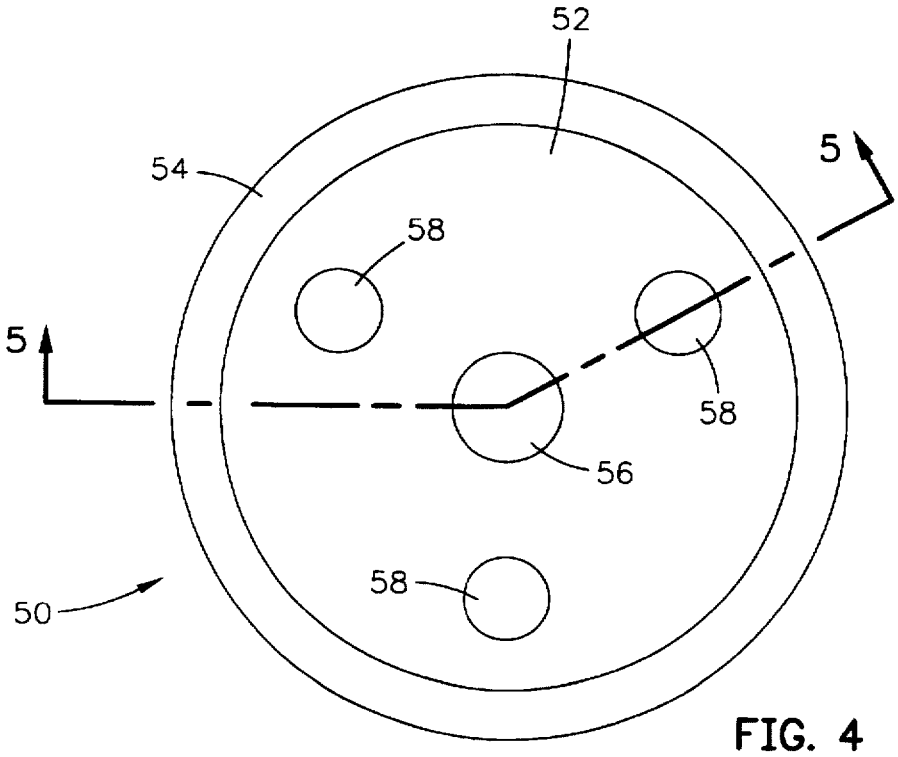
FIG. 4 is a top plan view of a dispensing wheel in accordance with the present invention.

Referring to FIG. 4, a dispensing wheel in accordance with the present invention is illustrated and designated generally by the numeral 50. This wheel is of unitary construction and may be constructed of either a plastic or a metal formed of an easily molded, machined or casted material such as any of the suitable food compatible plastics or metal such as aluminum or the like. The wheel and its preferred embodiment is formed with a circular planar face 52, having a peripheral upstanding rim 54. The disc is provided with a central cylindrical bore 56 providing a hub or journal for mounting on rod 38 in the machine of FIG. 1. A plurality of dispensing ports or through holes 58 are formed in the disc and positioned radially outward from the hub 56 to register with the chute of the base or housing of FIG. 1 for dispensing. These holes form cavities which fill with articles from the reservoir when an uncovered portion of the wheel is exposed to or registers with the reservoir. the walls of these holes may be coated with a suitable non-stick coating such as that available under the Trademark TEFLON.

Figure 5:
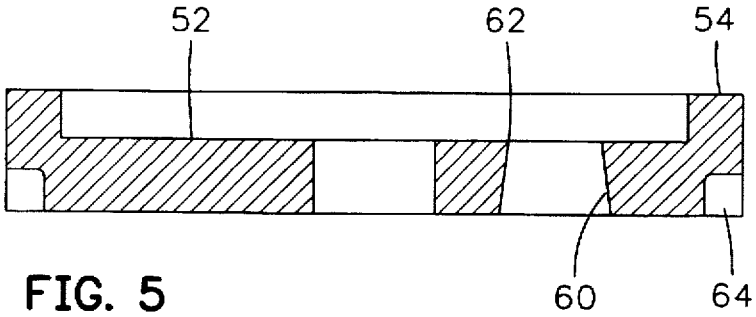
Figure 6:
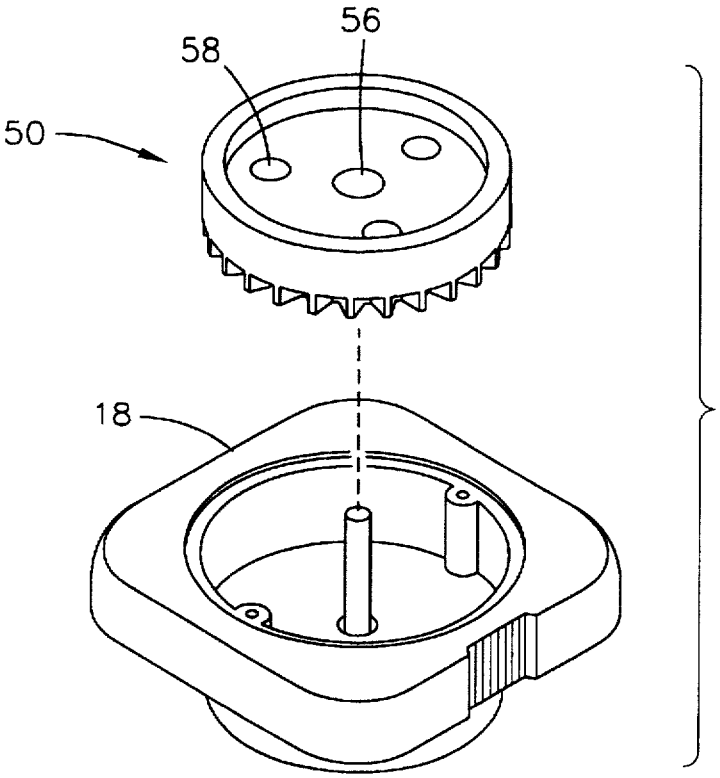
FIG. 6 is a perspective view of the embodiment of FIG. 4.

Referring to FIG. 5, a disc in accordance with the invention, has a generally dish configuration with a thickness of approximately ½" and diameter of about 4 ½". The recessed center is on the order of about ¼" with the peripheral rim preferably about ¼" high and ½" in width.

The through holes 58, as seen in FIG. 5, are formed preferably as circular holes with a diverging wall 60 diverging downwardly and outwardly from an upper edge 62 at the upper surface, which may preferably be a fairly sharp edge. The diverging wall 60 may be on the order of from 5°–25°, but is preferably on the order of about a 10°–15° angle from the center axis of the bore. This configuration enables the articles passing through the hole to fall away from the peripheral wall and does not become jammed or bound in the opening. This construction has been found to provide an effective and reliable dispensing wheel for the dispensing of certain difficult articles, such as gel caps and other similar bulk articles. The wheel, in accordance with this invention, overcomes the problems of the prior art, as discussed above. With this basic construction a wheel is selected to have a suitable size opening to accommodate the number of articles to be dispensed.

The wheel fits into and rests on the bottom surface of the receptacle 20 of the hopper as its prior dispensing wheels. The dispensing wheel is provided with the usual gear teeth 64 around the lower outer peripheral edge, which are cooperatively engaged by teeth on the coin operated mechanism 38 of the assembly of FIG. 1, for example.

Figure 2:
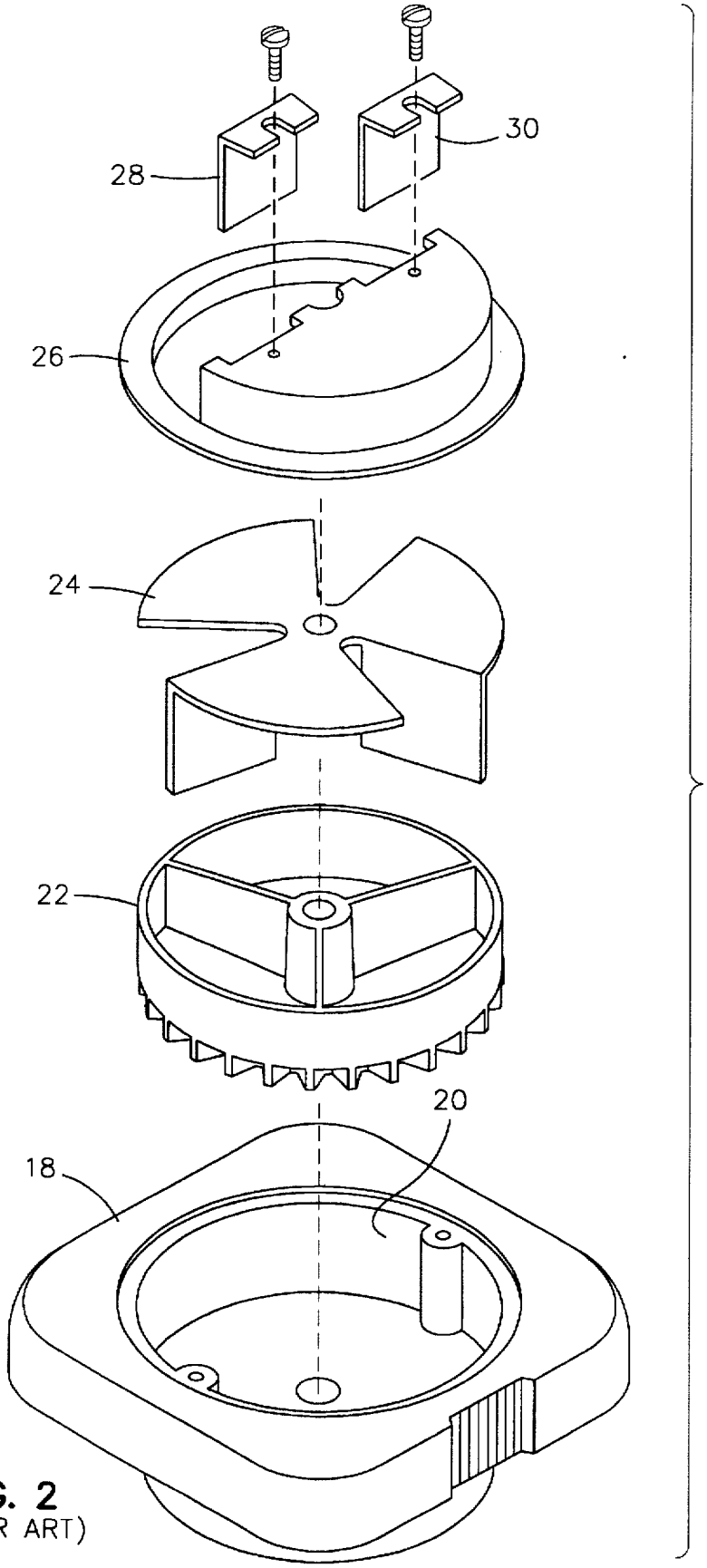
FIG. 2 (PRIOR ART)
FIG. 2 is an exploded perspective view of a typical prior art dispensing wheel for a machine of FIG. 1; an exemplary article vending machine embodying a dispensing wheel in accordance wish the present invention.
Figure 3:
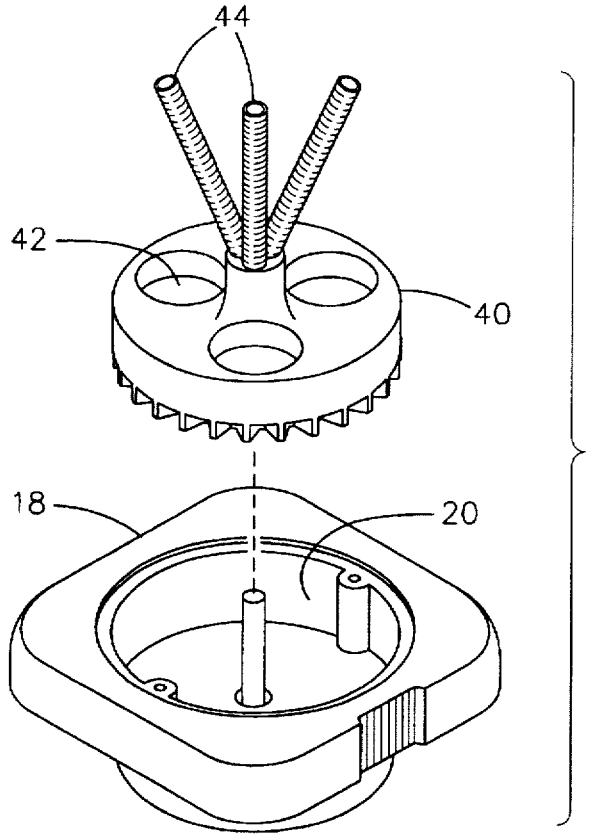
FIG. 3 (PRIOR ART)
FIG. 3 is a perspective view of an alternate prior art dispensing wheel for a machine of FIG. 1.

In operation, a proper dispensing wheel in accordance with the invention is selected and mounted in the dispensing assembly as of FIG. 2, for example. The dispensing wheel underlies the cover plate 26 with the spring units 28 and 30 providing gates to prevent passage of articles into the covered area of 26 other than through the opening 58 in the dispensing wheel. As an opening full of articles to be dispensed passes under the cover portion of 26, it registered with the upper opening of the chute 12 thereby emptying its contents into the chute. The consumer then opens the door 14 and retrieves the articles from the chute.

When the consumer desires articles from this dispensing machine, a coin is inserted into the coin-operated mechanism 38, in accordance with the usual practice and the handle of the mechanism is rotated, thereby rotating the dispensing wheel, in this case ⅓ of a turn. The dispensing wheel with its aperture filled with articles, rotates to a position that the filled aperture moves under the cover 26 and registers with the chute 12. The articles drop into the chute and are thereby dispensed and available to be retrieved by the consumer.

While in its preferred form the opening in the disc is selected to provide the desired quantity of articles to be dispensed, other modifications may be utilized to alter the number of articles to be dispensed. By way of example, a pivoting plug may be inserted in the opening to modify its capacity. A pivoting plug(not shown) similar to a flapper valve may be placed in the bottom of the respective opening to partially fill the opening to modify the capacity thereof. The pivoting plug then pivots away as the opening stops over opening into the chute to enable the articles to fall from the opening into the chute.

While I have illustrated and described my invention by means of specific embodiments, it is to be understood that numerous changes and modifications may be made therein without departing from the spirit and scope of the invention, as defined in the appended claims.

I claim:

1. A dispensing apparatus for dispensing unpackaged articles, comprising:

a housing having a receptacle and a dispensing chute;

an article reservoir mounted on said housing above said receptacle; and a rotatable dispensing wheel disposed between said receptacle and said dispensing chute and operative to selectively dispense articles from said receptacle to said chute, said dispensing wheel having at least one article cavity for receiving and depositing a predetermined quantity of articles in said chute, said cavity defined by a throughbore having walls diverging away from an upper peripheral edge.

2. An apparatus according to claim 1, wherein said dispensing wheel is a unitary structure having a plurality of said throughbores defining a plurality of said cavities.

3. An apparatus according to claim 1, wherein said dispensing wheel is a unitary structure having a lower surface with gear teeth around the perimeter thereof, an upper surface having an upstanding peripheral rim and a plurality of throughbores defining said cavities.

4. An apparatus according to claim 3, wherein said dispensing wheel is made of a plastic.

5. An apparatus according to claim 3, wherein said plurality of throughbores have a diverging taper of about five to twenty-five degrees.

6. An apparatus according to claim 1, wherein said dispensing wheel is a unitary molded structure of plastic having a lower planar surface with gear teeth around the perimeter thereof, an upper planar surface having an upstanding peripheral rim and a plurality of said cavities defined by throughbores.

7. An apparatus according to claim 6, wherein said throughbores have a frusto-conical configuration.

8. An apparatus according to claim 7 wherein said plurality of throughbores have a diverging taper of about five to twenty-five degrees.

9. An apparatus according to claim 7 wherein said taper is about ten to fifteen degrees.

10. A dispensing apparatus for dispensing unpackaged articles, comprising:

a housing having a receptacle and a dispensing chute;

an article reservoir mounted on said housing above said receptacle; and a rotatable dispensing wheel disposed between said receptacle and said dispensing chute and operative to selectively dispense articles from said receptacle to said chute, said dispensing wheel having at least one article cavity for receiving and depositing a predetermined quantity of articles in said chute, said cavity defined by walls diverging away from an upper peripheral edge, wherein said cavity is a through bore having a frusto-conical configuration.

11. An apparatus according to claim 10, wherein said dispensing wheel is a unitary structure having a plurality of said throughbores defining a plurality of said cavities.

12. An apparatus according to claim 10, wherein said dispensing wheel is a unitary structure having a lower surface with gear teeth around the perimeter thereof, an upper surface having an upstanding peripheral rim and a plurality or throughbores defining said cavities.

13. An apparatus according to claim 10 wherein said plurality of throughbores have a diverging taper of about five to twenty-five degrees.

14. A dispensing apparatus for dispensing bulk capsules, comprising:

a housing having a generally cylindrical receptacle and a dispensing chute communicating with said receptacle;

an article reservoir mounted on said housing above and communicating with said receptacle; and a rotatable dispensing wheel disposed in said receptacle and adapted to selectively communicate with said dispensing chute and operative to selectively dispense articles from said receptacle to said chute, said dispensing wheel having a plurality of article cavities for receiving and depositing a predetermined quantity of articles in said chute, said cavity defined by a through passage having downwardly diverging walls.

15. A system according to claim 14, wherein said dispensing wheel is a unitary structure and said plurality of throughbores are defined by fixed walls.

16. An apparatus according to claim 14, wherein said plurality of throughbores have a diverging taper of about at least five degrees.

17. An apparatus according to claim 14, wherein said throughbores have a frusto-conical configuration.

18. An system according to claim 17, wherein said dispensing wheel is a unitary molded structure of plastic having a lower planar surface with gear teeth around the perimeter thereof, an upper planar surface having an upstanding peripheral rim and a plurality of said cavities defined by throughbores.

19. A dispensing apparatus for dispensing bulk capsules, comprising:

a housing having a generally cylindrical receptacle and a dispensing chute communicating with said receptacle;

a bulk article reservoir mounted on said housing above and communicating with said receptacle; and a rotatable dispensing wheel of unitary structure disposed in said receptacle and adapted to selectively communicate with said reservoir and said dispensing chute and operative to selectively dispense a selected plurality of articles from said receptacle to said chute, said dispensing wheel having a plurality of article cavities for receiving and depositing said plurality of articles in said chute, said cavities defined by throughbores having downwardly diverging walls of a frusto-conical configuration.

20. The dispensing apparatus of claim 19, wherein said dispensing wheel is a unitary molded structure of plastic having a lower planar surface with gear teeth around the perimeter thereof, an upper planar surface having an upstanding peripheral rim and a plurality of said throughbores having a diverging angle of at least 5 degrees.

* * * * *